US006920917B2

(12) United States Patent
Inoue et al.

(10) Patent No.: US 6,920,917 B2
(45) Date of Patent: Jul. 26, 2005

(54) DOUBLE-PIPE HEAT EXCHANGER

(75) Inventors: Yuji Inoue, Shiga (JP); Noriho Okaza, Shiga (JP); Kazuo Nakatani, Osaka (JP); Yoshikazu Kawabe, Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 10/728,788

(22) Filed: Dec. 8, 2003

(65) Prior Publication Data

US 2005/0051310 A1 Mar. 10, 2005

(30) Foreign Application Priority Data

Dec. 10, 2002 (JP) ..... 2002-358032

(51) Int. Cl.[7] ..... F28D 7/10
(52) U.S. Cl. ..... 165/154
(58) Field of Search ..... 165/154–156

(56) References Cited

U.S. PATENT DOCUMENTS 4,194,560 A * 3/1980 Matsuzaki ..... 165/141
4,326,582 A 4/1982 Rosman et al.
4,372,374 A * 2/1983 Lee ..... 165/70
4,554,969 A * 11/1985 Carnavos ..... 165/154
4,924,838 A * 5/1990 McCandless ..... 123/541
5,375,654 A * 12/1994 Hougland et al. ..... 165/109.1
5,469,817 A * 11/1995 Hoag ..... 123/41.79
5,950,716 A * 9/1999 Appelquist et al. ..... 165/109.1
6,220,344 B1 * 4/2001 Beykirch et al. ..... 165/156

FOREIGN PATENT DOCUMENTS

DE 917 009 C 8/1954
GB 977 579 A 12/1964

* cited by examiner

*Primary Examiner*—Teresa J. Walberg
(74) *Attorney, Agent, or Firm*—Armstrong, Kratz, Quintos, Hanson & Brooks, LLP

(57) ABSTRACT

It is an object of the invention to provide an inexpensive double-pipe heat exchanger having high performance and comprising an inner pipe and an outer pipe which constitute a double pipe without adding a heat-transfer facilitating material such as an inner fin. In the double-pipe heat exchanger having the inner pipe and the outer pipe, the outer pipe is dented from its outside toward its inside, thereby forming a plurality of projections which are dented toward the inner pipe. Examples of shapes of the projection are substantially conical shape, substantially truncated shape, substantially spherical surface shape, substantially cylindrical shape, substantially elliptic cylindrical shape and the like. The projections are disposed helically or in a staggered configuration such as to surround the inner pipe. With this structure, only by subjecting the outer pipe to simple working such as press working, it is possible to increase the turbulent flow of fluid flowing between the inner pipe and the outer pipe, and to facilitate heat transfer from fluid flowing in the inner pipe to fluid flowing between the inner pipe and the outer pipe.

8 Claims, 5 Drawing Sheets

DOUBLE-PIPE HEAT EXCHANGER

TECHNICAL FIELD

The present invention relates to a double-pipe heat exchanger for exchange heat between water and refrigerant such as a water heater and an air conditioning system, and more particularly, to a double-pipe heat exchanger suitable for a water heater or an air conditioning system which heats water or warming brine in a heat pump cycle in which high side pressure becomes higher than critical pressure of refrigerant.

BACKGROUND TECHNIQUE

Conventionally, in a double-pipe heat exchanger of this type, a heat-transfer facilitating body such as an inner fin having dimple-like projections and depressions is inserted between an inner pipe and an outer pipe. The heat-transfer facilitating body produces turbulent flow, thereby it enhances the heat-transfer performance of the heat exchanger (see Patent Document 1 for example).

[Patent Document 1]

Japanese Patent Application Laid-open No. H9-145285 (pages 2 to 4, FIG. 4)

In the conventional structure, however, since the heat-transfer facilitating material such as the inner fin is required in addition to the inner pipe and the outer pipe which constitute a double-pipe, there is a problem that the material cost is higher than a normal double-pipe.

The present invention has been accomplished to solve such a conventional problem, and it is an object of the invention to provide a more inexpensive double-pipe heat exchanger having higher performance without adding a new material other than the inner pipe and the outer pipe, by enhancing the heat-transfer performance only by subjecting the outer pipe to simple working.

SUMMARY OF THE INVENTION

To achieve the above object, a first aspect of the present invention provides a double-pipe heat exchanger comprising an inner pipe and an outer pipe, wherein the outer pipe is dented from its outside toward its inside, thereby forming a plurality of projections on the inner side of the outer pipe.

In the double-pipe heat exchanger of the first aspect of the invention, it is unnecessary to add a new material except the inner pipe and the outer pipe, it is possible to increase the turbulent flow of fluid flowing through the inside passage of the outer pipe and to facilitate the heat transfer from fluid flowing through the inner pipe to fluid flowing between the inner pipe and the outer pipe only by subjecting the double-pipe heat exchanger to simple working, i.e., denting the outer pipe from its outside toward its inside and providing an inside of the outer pipe with the plurality of projections. In addition, even in the curved portions, the heat transfer performance is not deteriorated because a distance between the inner pipe and the outer pipe is substantially equally maintained by the projections of the outer pipe disposed around the inner pipe.

In a second aspect of the invention based on the first aspect, the projection is formed into substantially conical shape, substantially truncated shape, substantially spherical surface shape, substantially cylindrical shape, or substantially elliptic cylindrical shape.

According to the second aspect of the invention, in the double-pipe heat exchanger of the first embodiment, the projection is formed into a smooth projection shape toward the inner pipe, such as substantially conical shape, substantially truncated shape, substantially spherical surface shape, substantially cylindrical shape, or substantially elliptic cylindrical shape. Therefore, flowing resistance of fluid flowing between the inner pipe and the outer pipe is not increased so much, and deterioration of heat transfer performance caused by pressure loss can be reduced.

In a third aspect of the invention based on the first aspect, the plurality of projections are disposed in a staggered configuration.

According to the third aspect of the invention, in the double-pipe heat exchanger of the first embodiment, the plurality of projections of the outer pipe are disposed in the staggered configuration. With this structure, fluid between the inner pipe and the outer pipe is prevented from flowing straightly, the turbulent flow of fluid is facilitated, and heat transfer is further facilitated.

In a fourth aspect of the invention based on the first aspect, the plurality of projections are disposed helically.

According to the fourth aspect of the invention, in the double-pipe heat exchanger of the first embodiment, the projections are disposed helically. Thus, the fluid between the inner pipe and the outer pipe flows helically, the flow velocity of fluid is increased, the turbulent flow is facilitated and thus, the heat transfer performance is further facilitated.

In a fifth aspect of the invention based on the first aspect, a refrigerant passage is formed in the inner pipe, and a water passage is formed between the inner pipe and the outer pipe.

According to the fifth aspect of the invention, in the double-pipe heat exchanger of the first embodiment, the water passage is made as a passage between the inner pipe and the outer pipe on which the plurality of projections are disposed, and the interior of the inner pipe is made as a refrigerant passage because the heat transfer enhancing affect by increase of turbulent flow of water is greater than that of refrigerants. With this feature, heat transfer can be facilitated more effectively.

In a sixth aspect of the invention based on the fifth aspect, the inner pipe is a leakage detecting pipe.

According to the sixth aspect of the invention, in the double-pipe heat exchanger of the fifth embodiment, the inner pipe is made as the leakage detecting pipe having the leakage detecting grooves. With this feature, it is possible to find, at early stage, corrosion or the like of the inner pipe due to leakage of refrigerant or water into the leakage detecting pipe, it is possible to prevent refrigerant from being mixed into water (drinking water or the like), and safety can be secured.

In a seventh aspect of the invention based on the fifth aspect, carbon dioxide is used as the refrigerant.

According to the seventh aspect of the invention, in the double-pipe heat exchanger of the fifth embodiment, carbon dioxide has excellent heat transfer performance in the supercritical region, and the carbon dioxide is used as the refrigerant. With this feature, the heating efficiency of water is enhanced.

In an eighth aspect of the invention based on the fifth aspect, the refrigerant and water flow in opposite directions from each other.

According to the eighth aspect of the invention, in the double-pipe heat exchanger of the fifth embodiment, the refrigerant and water flow in opposite directions from each other. With this feature, the heat transfer performance from refrigerant to water can further be enhanced.

In a ninth aspect of the invention based on one of the fifth to eighth aspects, the number of the projections disposed on an exit side of the water is smaller than the number of the projections disposed on an entrance side of the water.

According to the ninth aspect of the invention, in the double-pipe heat exchanger of any of the fifth to eighth embodiments, the number of the projections disposed on an exit side of the water is smaller than the number of the projections disposed on an entrance side of the water so that a space between the inner pipe and the outer pipe on the side of the water exit where higher temperature water flows is increased. With this feature, it is possible to prevent the water passage from clogging which may be caused by scale such as calcium carbonate which is prone to be deposited in high temperature water.

In a tenth aspect of the invention based on one of the fifth to eighth aspects, the depth of the projections disposed on an exit side of the water is shallower than the depth of the projections disposed on an entrance side of the water.

According to the tenth aspect of the invention, in the double-pipe heat exchanger of any of the fifth to eighth embodiments, the depth of the projections disposed on an exit side of the water is shallower than the depth of the projections disposed on an entrance side of the water so that a space between the inner pipe and the outer pipe on the side of the water exit where higher temperature water flows is increased. With this feature, it is possible to prevent the water passage from clogging which may be caused by scale such as calcium carbonate which is prone to be deposited in high temperature water.

In an eleventh aspect of the invention based on one of the fifth to eighth aspects, the projections are not disposed on an exit side of the water.

According to the eleventh aspect of the invention, in the double-pipe heat exchanger of any of the fifth to eighth embodiments, the projections are not disposed on an exit side of the water so that a space between the inner pipe and the outer pipe on the side of the water exit where higher temperature water flows where higher temperature water flows is increased. With this feature, it is possible to prevent the water passage from clogging which may be caused by scale such as calcium carbonate which is prone to be deposited in high temperature water.

PREFERRED EMBODIMENT OF THE INVENTION

Embodiments of the present invention will be explained below with reference to the drawings.

Figure 1:
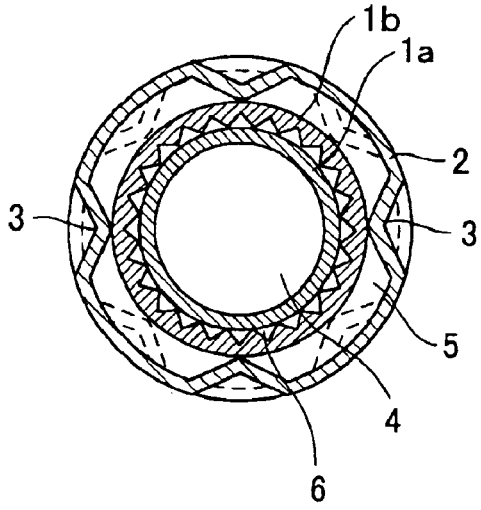
FIG. 1 is a sectional view of a double-pipe heat exchanger according to a first embodiment of the present invention.
Figure 2:
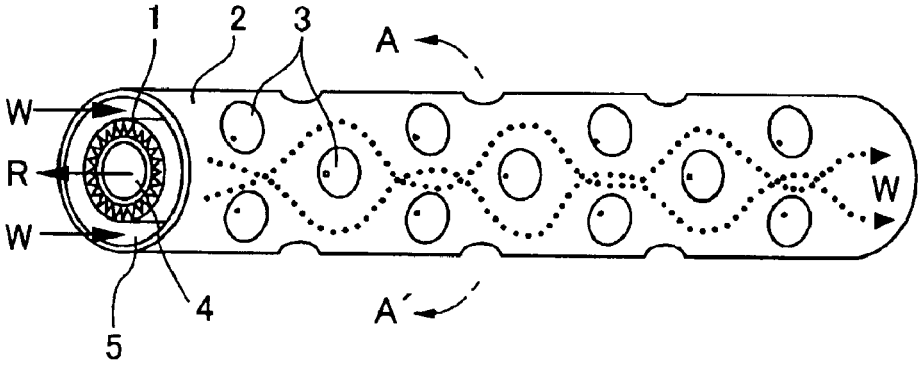
FIG. 2 is a view of a structure of an essential portion of the double-pipe heat exchanger of the first embodiment of the invention.

FIG. 1 is sectional view of a double-pipe heat exchanger and FIG. 2 is a view of a structure of an essential portion of the double-pipe heat exchanger, according to a first embodiment of the invention.

The double-pipe heat exchanger of this embodiment is used as a water refrigerant heat exchanger for warm water in a water heater using carbon dioxide as refrigerant. As shown in FIGS. 1 and 2, an inner pipe 1 is concentrically inserted into an outer pipe 2. FIG. 2 is a sectional view of the double-pipe heat exchanger taken along a line A-A' in FIG. 1.

In this embodiment, a refrigerant passage 4 through which refrigerant R flows is formed in the inner pipe 1. A water passage 5 through which water W flows is formed between the inner pipe 1 and the outer pipe 2. The refrigerant R and the water W flow in opposite directions from each other.

The outer pipe 2 has a plurality of substantially conical projections 3. The projections 3 are formed by denting the outer pipe 2 from its outside toward its inside by a working method such as press working. The projections 3 are disposed in a staggered configuration in a longitudinal direction of the outer pipe 2.

The inner pipe 1 comprises a leakage detecting pipe having leakage detecting grooves 6 which are continuously formed in a longitudinal direction of the inner pipe 1. The leakage detecting grooves 6 are formed between two pipes 1*a* and 1*b*. Each of the two pipes 1*a* and 1*b* is made of material having excellent heat conductivity such as copper.

The outer pipe 2 may not be made of material having excellent heat conductivity, but if connection strength between an exit portion of the inner pipe 1 and an exit portion of the outer pipe 2 and between an entrance portion of the inner pipe 1 and an entrance portion of the outer pipe 2 is taken into consideration, it is preferable to use the same material as that of the inner pipe 1. It is preferable that the outer pipe 2 is made of material having excellent corrosion-resistance with respect to water, e.g., copper.

According to the double-pipe heat exchanger having the above-described structure, the following effect can be obtained.

Between the inner pipe 1 and the outer pipe 2, the plurality of projections 3 are disposed in the staggered configuration such as to surround the inner pipe 1. With this structure, water is prevented from flowing straightly in the longitudinal direction of the pipe, the water flows such as to meander, the turbulent flow of water is facilitated, and heat transfer from the refrigerant flowing through the refrigerant passage 4 to water flowing through the water passage 5 is facilitated. Since the projections 3 are substantially conically and smoothly projected, the flowing resistance of fluid meandering through the water passage 5 is not increased so much, and deterioration of heat transfer performance caused by pressure loss can be reduced.

In this embodiment, the refrigerant R flows through the inner pipe 1 and the water W flows between the inner pipe and the outer pipe. On the contrary, water W may flow through the inner pipe and the refrigerant R may flow between the inner pipe and the outer pipe. However, the heat transfer enhancing effect by increase of turbulent flow of water is greater than that of refrigerant. Therefore, if water is allowed to flow between the inner pipe and the outer pipe having the projections 3, the heat transfer can be facilitated more effectively.

In order to accommodate the double-pipe heat exchanger of this type in a small space, the inner pipe 1 is inserted into the outer pipe 2 and furthermore, the double-pipe heat exchanger is wound into a coil shape in some cases. In this case, the projections 3 disposed around the inner pipe 1 keeps the concentric state between the inner pipe 1 and the outer pipe 2 and even their curved or wound portions. Thus, a distance between the inner pipe 1 and the outer pipe 2 does not become extremely wide or narrow, and the heat transfer performance can be prevented from being deteriorated.

The leakage detecting pipe having the leakage detecting grooves 6 is employed in the inner pipe 1. Thus, it is possible to find, at early stage, corrosion or the like of the inner pipe 1 due to leakage of refrigerant R or water W into the leakage detecting pipe, it is possible to prevent refrigerant from being mixed into water (drinking water or the like), and safety can be secured.

Figure 3:
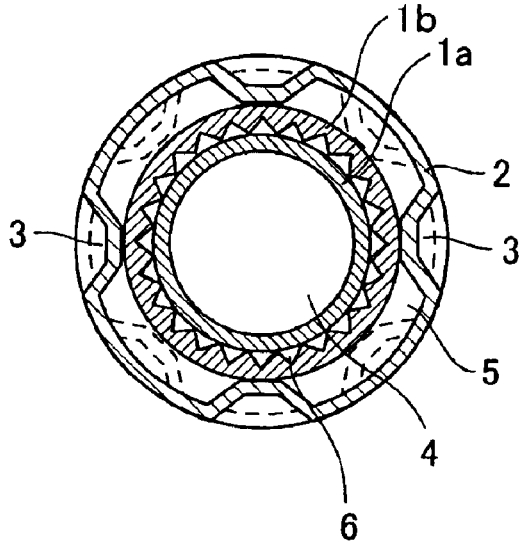
FIG. 3 is a sectional view of a double-pipe heat exchanger according to another embodiment of the invention.
Figure 4:
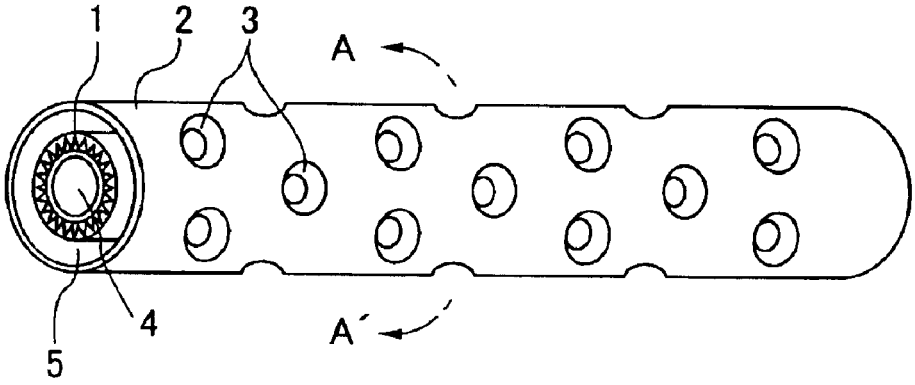
FIG. 4 is a view of a structure of an essential portion of the double-pipe heat exchanger of the other embodiment of the invention.
Figure 5:
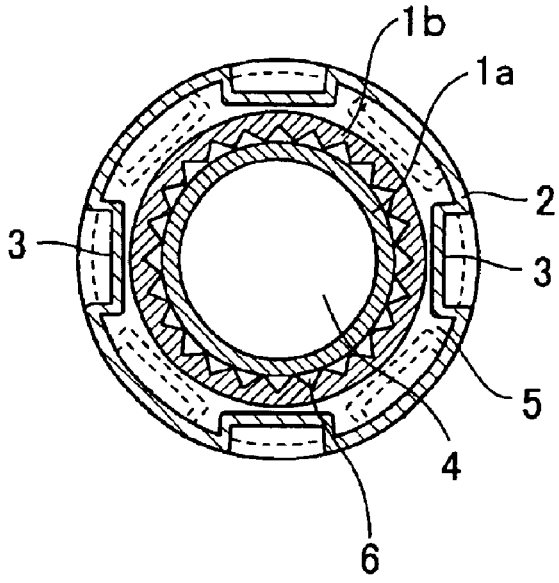
FIG. 5 is a sectional view of a double-pipe heat exchanger according to another embodiment of the invention.
Figure 6:
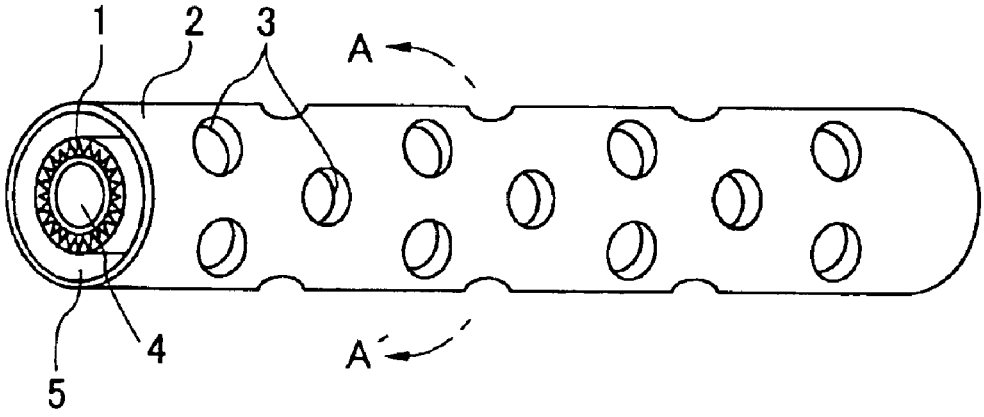
FIG. 6 is a view of a structure of an essential portion of the double-pipe heat exchanger of the other embodiment of the invention.

The plurality of projections 3 of the first embodiment may be formed into substantially truncated projections (or elliptic truncated projections) which are dented toward the inner pipe 1 as shown in FIGS. 3 and 4, or may be formed into cylindrical projections (or elliptic cylindrical projections) as shown in FIGS. 5 and 6. Other shaped projections may also be employed, e.g., the projection may have substantially spherical shape in which the entire projection is rounded.

Figure 7:
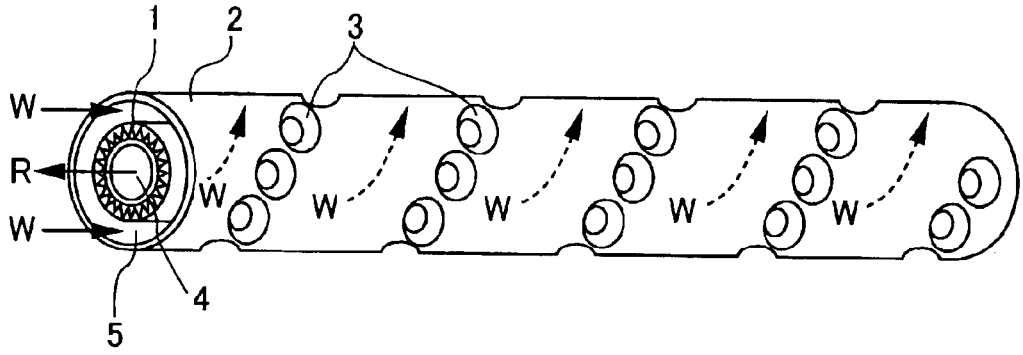
FIG. 7 is a sectional view of a double-pipe heat exchanger according to a second embodiment of the invention.

FIG. 7 shows a structure of an essential portion of a double-pipe heat exchanger according to a second embodiment of the invention.

The plurality of projections 3 of the outer pipe 2 are disposed such as to helically surround the inner pipe 1. Thus, fluid (water W) between the inner pipe 1 and the outer pipe 2 flows helically, the flow velocity of the fluid (water W) is increased, the turbulent flow is facilitated, and the heat transfer performance is further facilitated.

Figure 8:
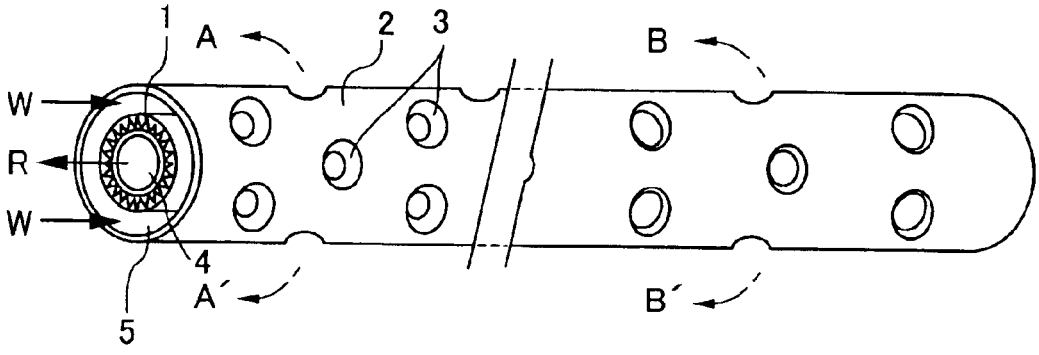
FIG. 8 is a sectional view of a double-pipe heat exchanger according to a third embodiment of the invention.
Figure 9:
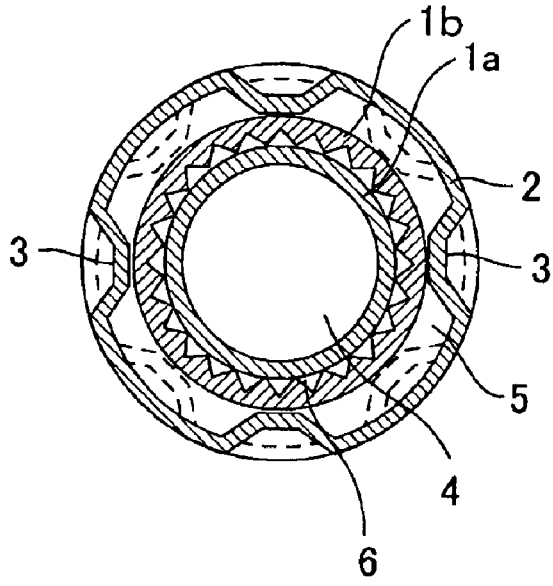
FIG. 9 is a sectional view of the double-pipe heat exchanger taken along a line A–A' in FIG. 8.
Figure 10:
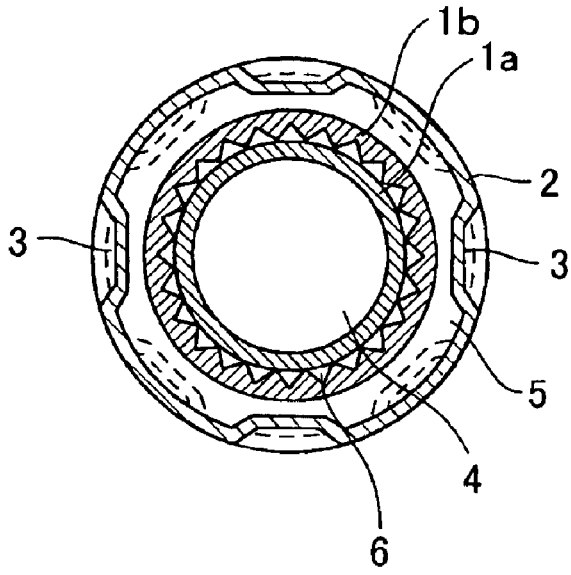
FIG. 10 is a sectional view of the double-pipe heat exchanger taken along a line B–B' in FIG. 8.

FIGS. 8 to 10 show a double-pipe heat exchanger according to a third embodiment of the invention.

FIG. 9 shows a cross section (A–A') of the double-pipe heat exchanger closer to a water entrance. FIG. 10 shows a cross section (B–B') of the double-pipe heat exchanger closer to a water exit.

The number of projections 3 per unit length in the water entrance area is smaller than that in the water exit area. As shown in FIGS. 9 and 10, depth of the projections 3 disposed in the water entrance area is shallower than that in the water exit area. With this structure, the passage between the inner pipe 1 and the outer pipe 2 closer to the water exit through which high temperature water flows can be secured widely, and it is possible to avoid clogging of the water passage which may be caused by scale such as calcium carbonate deposited by high temperature water. When a distance between the inner pipe 1 and the outer pipe 2 is originally small, the closing of the water passage due to scale or the like can be prevented by disposing no projections 3 in the water exit area.

As apparent from the above embodiments, according to the present invention, in a double-pipe heat exchanger comprising an inner pipe and an outer pipe, the outer pipe is dented from its outside toward its inside, thereby forming a plurality of projections on the inner side of the outer pipe. With such a simple working, it is possible to increase the turbulent flow of fluid flowing through the inside passage of the outer pipe and to facilitate the heat transfer from fluid flowing through the inner pipe to fluid flowing between the inner pipe and the outer pipe. Further, even in the curved portions, the heat transfer performance is not deteriorated because a distance between the inner pipe and the outer pipe is substantially equally maintained by the projections of the outer pipe disposed around the inner pipe. Thus, the heat transfer performance is enhanced only by subjecting the outer pipe to the simple working without adding a material for a heat-transfer facilitating body such as an inner fin except the inner pipe and the outer pipe. Therefore, it is possible to provide an inexpensive double-pipe heat exchanger having excellent performance.

Further, according to the invention, the projection of the outer pipe is formed into a smooth projection shape toward the inner pipe, such as substantially conical shape, substantially truncated shape, substantially spherical surface shape, substantially cylindrical shape, or substantially elliptic cylindrical shape. Therefore, flowing resistance of fluid flowing between the inner pipe and the outer pipe is not increased so much, and deterioration of heat transfer performance caused by pressure loss can be reduced. Therefore, it is possible to provide a double-pipe heat exchanger having more excellent performance.

Further, according to the invention, the plurality of projections of the outer pipe are disposed in the staggered configuration. With this structure, fluid between the inner pipe and the outer pipe is prevented from flowing straightly, the turbulent flow of fluid is facilitated, and heat transfer is further facilitated. Therefore, it is possible to provide a double-pipe heat exchanger having more excellent performance.

Further, according to the invention, the projections of the outer pipe are disposed such as to helically surround the inner pipe. Thus, the fluid between the inner pipe and the outer pipe flows helically, the flow velocity of fluid is increased, the turbulent flow is facilitated and thus, the heat transfer performance is further facilitated. Therefore, it is possible to provide a double-pipe heat exchanger having more excellent performance.

Further, according to the invention, the water passage is made as a passage between the inner pipe and the outer pipe on which the plurality of projections are disposed, and the interior of the inner pipe is made as a refrigerant passage because the heat transfer enhancing effect by increase of turbulent flow of water is greater than that of refrigerants. With this feature, heat transfer can be facilitated more effectively. Therefore, it is possible to provide a double-pipe heat exchanger having more excellent performance.

Further, according to the invention, the inner pipe is made as the leakage detecting pipe having the leakage detecting grooves. With this feature, it is possible to find, at early stage, corrosion or the like of the inner pipe due to leakage of refrigerant or water into the leakage detecting pipe, it is possible to prevent refrigerant from being mixed into water (drinking water or the like), and safety can be secured. Therefore, it is possible to provide a double-pipe heat exchanger having higher safety.

Further, according to the invention, carbon dioxide has excellent heat transfer performance in the supercritical region, and the carbon dioxide is used as the refrigerant. With this feature, the heating efficiency of water is enhanced. Therefore, it is possible to provide a double-pipe heat exchanger having more excellent performance.

Further, according to the invention, the refrigerant and water flow in opposite directions from each other. With this feature, the heat transfer performance from refrigerant to water can further be enhanced. Therefore, it is possible to provide a double-pipe heat exchanger having more excellent performance.

Further, according to the invention, the number and depth of the projections disposed on an exit side of the water is smaller than the number and shallower than the depth of the projections disposed on an entrance side of the water and the projections are not disposed on an exit side of the water so that a space between the inner pipe and the outer pipe on the side of the water exit where higher temperature water flows is increased. With this feature, it is possible to prevent the water passage from clogging which may be caused by scale such as calcium carbonate which is prone to be deposited in high temperature water. Therefore, it is possible to provide a double-pipe heat exchanger having higher reliability.

What is claimed is:

1. A double-pipe heat exchanger comprising an inner pipe and an outer pipe, wherein said outer pipe is dented from its outside toward its inside, thereby forming a plurality of projections on the inner side of said outer pipe, wherein a refrigerant passage is formed in said inner pipe, and a water passage is formed between said inner pipe and said outer pipe, wherein the refrigerant and water flow in opposite directions from each other, wherein the number of said projections disposed on an exit side of the water is smaller than the number of said projections disposed on an entrance side of the water.

2. A double-pipe heat exchanger comprising an inner pipe and an outer pipe, wherein said outer pipe is dented from its outside toward its inside, thereby forming a plurality of projections on the inner side of said outer pipe, wherein a refrigerant passage is formed in said inner pipe, and a water passage is formed between said inner pipe and said outer pipe, wherein the refrigerant and water flow in opposite directions from each other, wherein the depth of the projections disposed on an exit side of the water is shallower than the depth of the projections disposed on an entrance side of the water.

3. A double-pipe heat exchanger comprising an inner pipe and an outer pipe, wherein said outer pipe is dented from its outside toward its inside, thereby forming a plurality of projections on the inner side of said outer pipe, wherein a refrigerant passage is formed in said inner pipe, and a water passage is formed between said inner pipe and said outer pipe, wherein the refrigerant and water flow in opposite directions from each other, wherein said projections are not disposed on an exit side of the water.

4. The double-pipe heat exchanger according to any one of claims 1, 2 and 3, wherein each of said projections have one of a substantially conical shape, a substantially truncated shape, substantially spherical surface shape, a substantially cylindrical shape, or a substantially elliptic cylindrical shape.

5. The double-pipe heat exchanger according to any one of claims 1, 2 and 3, wherein the plurality of projections are disposed in a staggered configuration.

6. The double-pipe heat exchanger according to claim any one of claims 1, 2 and 3, wherein the plurality of projections are disposed helically.

7. The double-pipe heat exchanger according to claim any one of claims 1, 2 and 3, wherein said inner pipe is a leakage detecting pipe.

8. The double-pipe heat exchanger according to claim any one of claims 1, 2 and 3, wherein carbon dioxide is used as the refrigerant.

* * * * *